United States Patent [19]

Gladd et al.

[11] 4,239,319

[45] Dec. 16, 1980

[54] ELECTRICAL COMPONENT PACKAGE FOR INTERCONNECTION BETWEEN PLUG AND SOCKET CONNECTORS

[75] Inventors: Joseph H. Gladd; Theodore H. Horrell, Jr., both of Cortland; Robert G. Plyler, Vienna, all of Ohio

[73] Assignee: General Motors Corporation, Detroit, Mich.

[21] Appl. No.: 959,990

[22] Filed: Nov. 13, 1978

[51] Int. Cl.[3] ..... H01R 13/28

[52] U.S. Cl. ..... 339/147 R; 339/166 R

[58] Field of Search ..... 339/47, 49 R, 147 R, 339/147 P, 153, 154, 166 R, 256 SP, 258 S

[56] References Cited

U.S. PATENT DOCUMENTS

| | | | |
|---|---|---|---|
| 2,703,395 | 3/1955 | Long | 339/258 S |
| 3,037,183 | 5/1962 | Hopkins | 339/217 |
| 3,076,171 | 1/1963 | Hopkins | 339/258 |
| 3,391,383 | 7/1968 | Antes | 339/174 |
| 3,644,872 | 2/1972 | Russo, Jr. | 339/47 R |
| 3,745,515 | 7/1973 | Michaels | 339/156 R |
| 3,820,054 | 6/1974 | Clewes et al. | 339/17 CF |
| 4,018,981 | 4/1977 | Hawkins | 339/147 R |

FOREIGN PATENT DOCUMENTS

| | | | |
|---|---|---|---|
| 2146847 | 3/1973 | Fed. Rep. of Germany | 339/147 P |
| 2457248 | 7/1975 | Fed. Rep. of Germany | 339/147 R |

OTHER PUBLICATIONS

Packard Electric Division Catalog-pp. D-22 & C-5.

*Primary Examiner*—Joseph H. McGlynn
*Attorney, Agent, or Firm*—F. J. Fodale

[57] ABSTRACT

A diode package is interconnected between matable plug and socket connectors of wiring harnesses. The diode package comprises a connector body housing a subassembly comprising a pair of hermaphroditic terminals connected to the leads of a diode. The connector body has socket and plug portions at opposite ends which are shaped to mate in an inverted relationship. The hermaphroditic terminals are of opposite hand and each have box-like female and male blade contacts at opposite ends which are shaped to mate in an inverted relationship.

1 Claim, 5 Drawing Figures

ELECTRICAL COMPONENT PACKAGE FOR INTERCONNECTION BETWEEN PLUG AND SOCKET CONNECTORS

This invention relates generally to a package containing an electrical component, such as a diode, for connection into an electrical circuit as a shunt. Such devices are commonly used to protect low capacity electrical components (such as transistors) in a circuit from undesirable transient conditions produced by another component in the circuit (such as the reverse electromotive force produced when a coil inductor is shut off).

U.S. Pat No. 4,018,981 granted to Harold G. Hawkins Apr. 19, 1977 for an "Electrical Component Package" discloses a package containing a diode. The package is designed to receive a pair of female terminals attached to lead wires for connecting the diode into an electrical circuit as a shunt. Consequently the diode package disclosed in the Hawkins patent poses the problem of providing the required female terminals and lead wires and their proper connection to an electrical circuit.

Electrical circuits in vehicles, particularly automobiles, in large part consist mainly of wiring harnesses connected to each other and containing a plurality of individual electrical components such as batteries, lights, ignition switch, fuse block, etc. and thus include many mating plug and socket connectors.

The possibilities for installing the Hawkins package in a vehicle are: providing a pair of terminals and lead wires as part of one of the vehicle wiring harnesses; providing a pair of female terminals and lead wires as a pig tail adapted for direct connection to the electrical component to be shunted; or for splicing into one of the vehicle wiring harnesses; or providing a pig tail having a tee connector such as shown in U.S. Pat. No. 3,745,515 issued to Leonard H. Michaels July 10, 1973.

The object of this invention is to provide a package for an electrical component, such as a diode, which can be interconnected between plug and socket connectors of an electrical circuit thereby eliminating the need for lead wires and auxiliary components, such as terminals and/or connectors for connecting the lead wires to the circuit.

Another object of this invention is to provide an electrical component package for an electrical circuit having a plug and socket connector which is complete in itself and requires nothing other than existing components of the circuit.

Still another object of this invention is to provide a complete electrical component package for electrical circuits having a plug and socket connector which is compact, simple in construction and easily installed.

Yet another object of this invention is to provide an electrical component package which includes hermaphroditic terminals attached to the electrical component to form a subassembly for manufacturing efficiency.

Other objects and features of the invention will become apparent to those skilled in the art as the disclosure is made in the following detailed description of a preferred embodiment of the invention as illustrated in the accompanying sheets of drawing in which:

FIG. 1 is a top sectional view of a diode package in accordance with this invention;

FIG. 1*a* is a perspective view of a blank for making the hermaphroditic terminals shown in FIG. 1;

Figure 1:
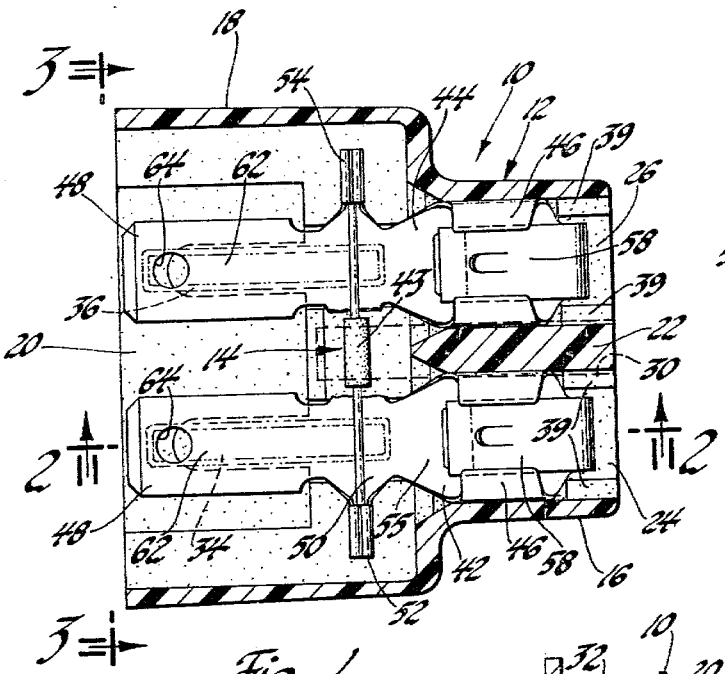

Referring now to the drawing the diode package 10 comprises a molded connector body 12 of polypropylene or other suitable dielectric material and a terminal-diode subassembly 14.

The connector body 12 has a plug portion 16 at one end and an enlarged socket portion 18 at the opposite end. The socket portion 18 has a single large chamber 20 adapted to receive a plug connector shaped like the plug portion 16 in an inverted position. The plug portion 16 has a partition wall 22 separating a pair of side-by-side terminal receiving cavities 24 and 26. The cavities 24 and 26 are open at the plug end of the connector body 12 and extend back to communicate with the single large chamber 20 which in turn is open at the socket end of the connector body.

The plug portion 16 has a pair of laterally spaced longitudinal slots 28 which extend through its top wall and communicate with the terminal cavities 24 and 26 respectively. The bottom wall of the plug portion has a central longitudinal groove 30 aligned with the partition wall 22. The slots 28 and groove 30 are a keying means to insure proper connection with a mating socket connector. Since the socket portion 18 of the connector body 12 is adapted to receive a plug connector shaped like the plug portion 16 in an inverted position, the pattern of the cooperating keying means is inverted. Thus, the top wall of the socket portion 18 has a central longitudinal rib 32 and the bottom wall has a pair of laterally spaced longitudinal ribs 34 and 36 projecting into the chamber 20.

Each of the terminal cavities 24 and 26 has a conventional latch shoulder 38 aligned with the rib 34 or 36, a pair of elevated side ribs 37 for terminal positioning and four corner blocks 39 at the open end forming guide slots. The side walls of the socket portion 18 are bulged to provide side channels 40 which communicate with the chamber 20.

The terminal-diode subassembly 14 comprises a pair of hermaphroditic terminals 42 and 44 connected to the respective leads of a diode 43.

Figure 1A:
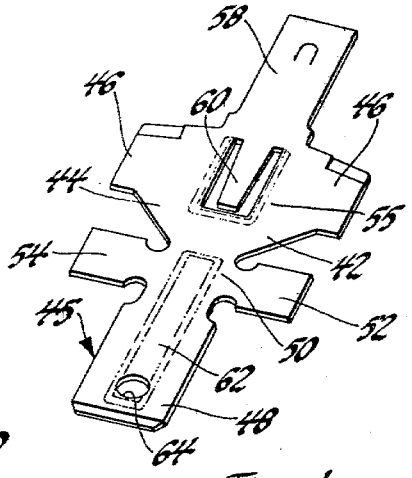

The hermaphroditic terminals 42 and 44 are preferably manufactured identical to each other from a blank 45 such as shown in FIG. 1*a* and then slightly modified for opposite hand versions.

The premodified terminal when made from the blank 45 comprises a box-like female contact 46 at one end, a male blade contact 48 at the opposite end and an intermediate body 50 having U-shaped crimp barrels 52 and 54 which project in opposite lateral directions. The terminal 42 is then formed simply by removing the crimp barrel 54 and the terminal 44 by removing the crimp barrel 52. Aside from this modification, the terminals 42 and 44 are otherwise identical.

The female contact 46 is of a conventional known design disclosed in U.S. Pat. No. 3,037,183 granted to Joseph H. Hopkins on May 29, 1962. Briefly the female contact 46 has a planar base portion 55; integral flanged sides 56 forming a box-like structure; an integral flat cantilevered spring tongue 58 cooperating with the box-like structure to biasingly engage a mating male blade; and a resilient latch finger 60 for locking the terminal in a connector body.

Figure 2:
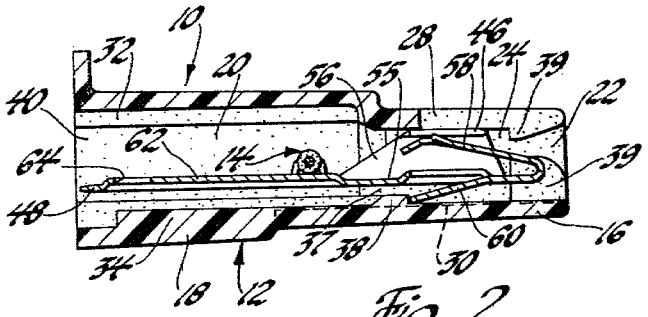
FIG. 2 is a side sectional view taken substantially along the line 2—2 of FIG. 1 looking in the direction of the arrows.
Figure 3:
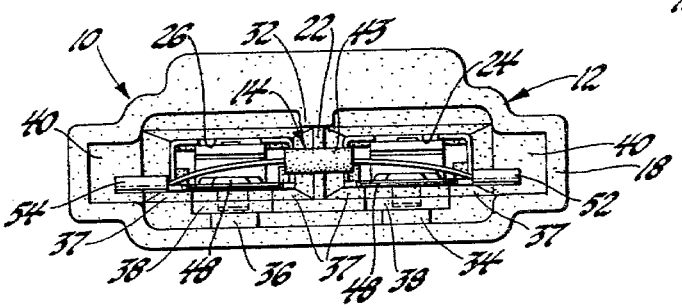
FIG. 3 is a rear end view taken substantially along the line 3—3 of FIG. 1 looking in the direction of the arrows.

In order to facilitate progressively die forming the terminals 42 and 44 in strip form, the intermediate body 50 and the male blade contact 48 are substantially flat and coplanar with the base portion 55 of the female contact 46. The male blade contact 48 and intermediate body 50, however, have a raised central platform 62 to increase their stiffness and the effective thickness of the male blade contact 48 and consequent increased pressure contact by a female contact like the female contact 46 at the opposite end of the terminal 42 or 44. The platform 62 has an aperture 64 at an end remote from the female contact 46 which cooperates with a protrusion on the tongue 58 in known manner. The position of the male blade contact 48 is lower than that of the female contact 46 and consequently its orientation is inverted with respect to the female contact 46. That is, the male blade contact 48 is upside-down from the position shown in FIG. 2 when it is inserted in a female contact 46 in the position shown in FIG. 2. However, this inverted orientation which produces a slight assembly inconvenience is more than offset by advantages in progressively die forming the terminal with a stiff blade of increased effective thickness. And, as noted infra, the connector body 12 is designed to insure proper interconnection between socket and plug connectors by inverting the pattern of the ribs 32, 34 and 36 with respect to the pattern of the slots 28 and groove 30.

The hermaphrodite terminals 42 and 44 are preferably manufactured identical to each other in strip form and fed in reels to an assembly machine which juxtaposes a pair of terminals, modifies the juxtaposed terminals to opposite hand versions and attaches a diode 43 to modified juxtaposed terminals of opposite hand by crimping the U-shaped crimp barrels 52 and 54 around the opposite lead wires of the diode 43. The attached crimp barrels provide a secure mechanical connection forming a terminal-diode subassembly 14. The electrical connection may also be enhanced by conventional techniques such as dip soldering. The opposite hand versions which are advantageously made from a common design also have U-shaped crimp barrels 52 and 54 which extend away from each other in the lateral direction. This permits a normal lateral spacing of the contact portions 46.

The terminal-diode subassembly 14 is then inserted into the socket opening of the connector body 12 female contact end first as a preassembled unit. The female contacts 46 pass through the chamber 20 and enter the individual terminal receiving cavities 24 and 26. Overinsertion is prevented by the lower corner blocks 39 and the female contacts 46 are latched in the cavities 24 and 26 by the latch fingers 60 engaging the latch shoulders 38. When latched, the female contacts 46 properly position the male blade contacts 48 and diode 43 in the common chamber 20 with the side channels 40 accommodating the laterally projecting crimp barrels 52 and 54.

Figure 4:
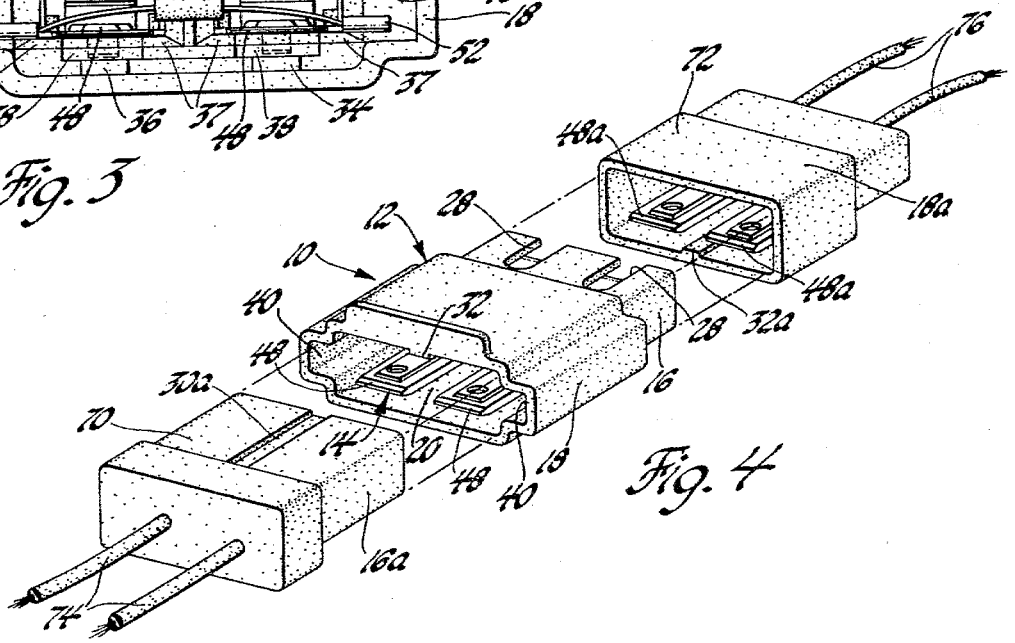
FIG. 4 is an exploded perspective view showing the diode package connected in a wiring harness.

FIG. 4 shows portions of wiring harnesses having a mating plug connector 70 and socket connector 72 which are disengaged and inverted with respect to each other.

The plug connector 70 has a portion 16*a* shaped like the plug portion 16 of the diode package 10 and consequently includes keying means comprising a groove 30*a* in one wall (corresponding to the groove 30) and a pair of laterally spaced slots (not shown) in the opposite wall (corresponding to the slots 28). The plug connector 70 houses a pair of terminals (not shown but substantially the same as the terminals shown in the aforementioned Hopkins patent) attached to the lead wires 74 by conventional crimp barrels. These terminals have female contacts substantially the same as the female contacts 46 of the hermaphroditic terminals 42 and 44.

The socket connector 72 has a portion 18*a* like the socket portion 18 of the diode package except for the side wall bulges and side channels provided thereby which are not necessary. The portion 18*a*, however, does have keying means comprising a single central rib 32*a* which projects inwardly from the bottom wall and a pair of laterally spaced ribs (not shown) which project inwardly from the top wall corresponding to the ribs 32, 34 and 36 respectively. The socket connector 72 likewise houses a pair of terminals having conventional crimp barrels for attaching the terminals to lead wires 76. These terminals have male blade contacts 48*a* which are suitably configured to mate with the female contacts in the plug connector 70 as well as the female contacts 46 of the hermaphroditic terminals 42 and 44 in the diode package 10.

The assembled diode package 10 is installed in the wiring harness simply by disconnecting the plug connector 70 from a socket connector 72; inverting the plug connector 70 to the upside-down position shown in FIG. 4; plugging the plug connector 70 into the socket portion 18 of the diode package 10; and then plugging the plug portion 16 of the diode package 10 into the socket connector 72.

We wish it to be understood that we do not desire to be limited to the exact details of construction shown and described, for obvious modifications will occur to a person skilled in the art.

We claim:

1. An electrical component package for interconnection between matable plug and socket connectors having male and female terminals of mating configuration, said package comprising a connector body of dielectric material having a plug portion at an end thereof and a socket portion at an opposite end thereof, said plug portion, and said socket portion being adapted to be connected respectively with a socket connector and a plug connector which is matable with the socket connector, said connector body having a pair of laterally spaced terminal cavities open at an end thereof and communicating with a common cavity which is open at an opposite end thereof, a pair of hermaphroditic terminals each having an elongated generally flat body having box-like female and male blade contacts of mating configuration formed on opposite longitudinal ends thereof which are matable respectively with male and female terminals of the socket and plug connectors, said male blade contact having a raised central platform which extends into the median portion of the flat body to stiffen the terminal and increase the effective thickness of the male blade contact when inserted upside-down into a female terminal shaped like the female contact, and an electrical component having a pair of wire leads connected respectively with the pair of hermaphroditic terminals at a lateral extension of the median portion of the elongated generally flat body, to form a subassembly which is insertable into the connector body via the common cavity, each of said pair of hermaphroditic terminals having one contact latched in a respective one of said pair of laterally spaced terminal cavities and positioning the other contact and the electrical component in the common cavity.

* * * * *